United States Patent [19]

Kessler et al.

[11] 4,209,304

[45] Jun. 24, 1980

[54] COAL GASIFICATION-METHOD OF FEEDING DRY COAL

[75] Inventors: Richard V. Kessler; John T. Nolan, Jr., both of Wappingers Falls, N.Y.

[73] Assignee: Texaco Inc., White Plains, N.Y.

[21] Appl. No.: 920,939

[22] Filed: Jun. 30, 1978

[51] Int. Cl.[2] ..... C10J 3/10

[52] U.S. Cl. ..... 48/202; 34/10; 48/86 R; 48/210; 48/DIG. 4; 406/61

[58] Field of Search ..... 48/197 R, 202, 206, 48/86 R, 63, DIG. 4, 204, 210; 34/10; 302/53, 59, 49; 406/61

[56] References Cited

U.S. PATENT DOCUMENTS

| | | | |
|---|---|---|---|
| 749,302 | 1/1904 | Koneman | 48/204 |
| 2,586,703 | 2/1952 | Odell | 48/DIG. 4 |
| 2,621,083 | 12/1952 | Daniels | 48/DIG. 4 |
| 2,633,417 | 3/1953 | Gornowski et al. | 48/DIG. 4 |
| 2,654,664 | 10/1953 | Reichl et al. | 48/DIG. 4 |
| 2,698,227 | 12/1954 | Peery et al. | 48/DIG. 4 |
| 2,933,822 | 4/1960 | Nathan | 34/10 |
| 3,036,906 | 5/1962 | Zellerhoff et al. | 48/63 |
| 3,104,020 | 9/1963 | Klapp | 406/61 |
| 3,976,442 | 8/1976 | Paull et al. | 48/210 |
| 3,994,701 | 11/1976 | Schweimanns | 48/86 R |

FOREIGN PATENT DOCUMENTS

| | | | |
|---|---|---|---|
| 262901 | 12/1926 | United Kingdom | 48/86 R |

*Primary Examiner*—S. Leon Bashore
*Assistant Examiner*—George C. Yeung
*Attorney, Agent, or Firm*—Carl G. Ries; Robert A. Kulason; Henry C. Dearborn

[57] ABSTRACT

A method of feeding powdered coal to a high pressure reactor which is being used with a fluidized bed/entrained flow coal gasification process. It includes steps of feeding a moist powdered coal to an extruder, and extruding the mixture into a high pressure stream of gas. The extrudate is dispersed into the gas stream, and the stream of extrudate and gas carrier is dried. Then the dry extrudate is separated and fed into the reactor vessel.

14 Claims, 1 Drawing Figure

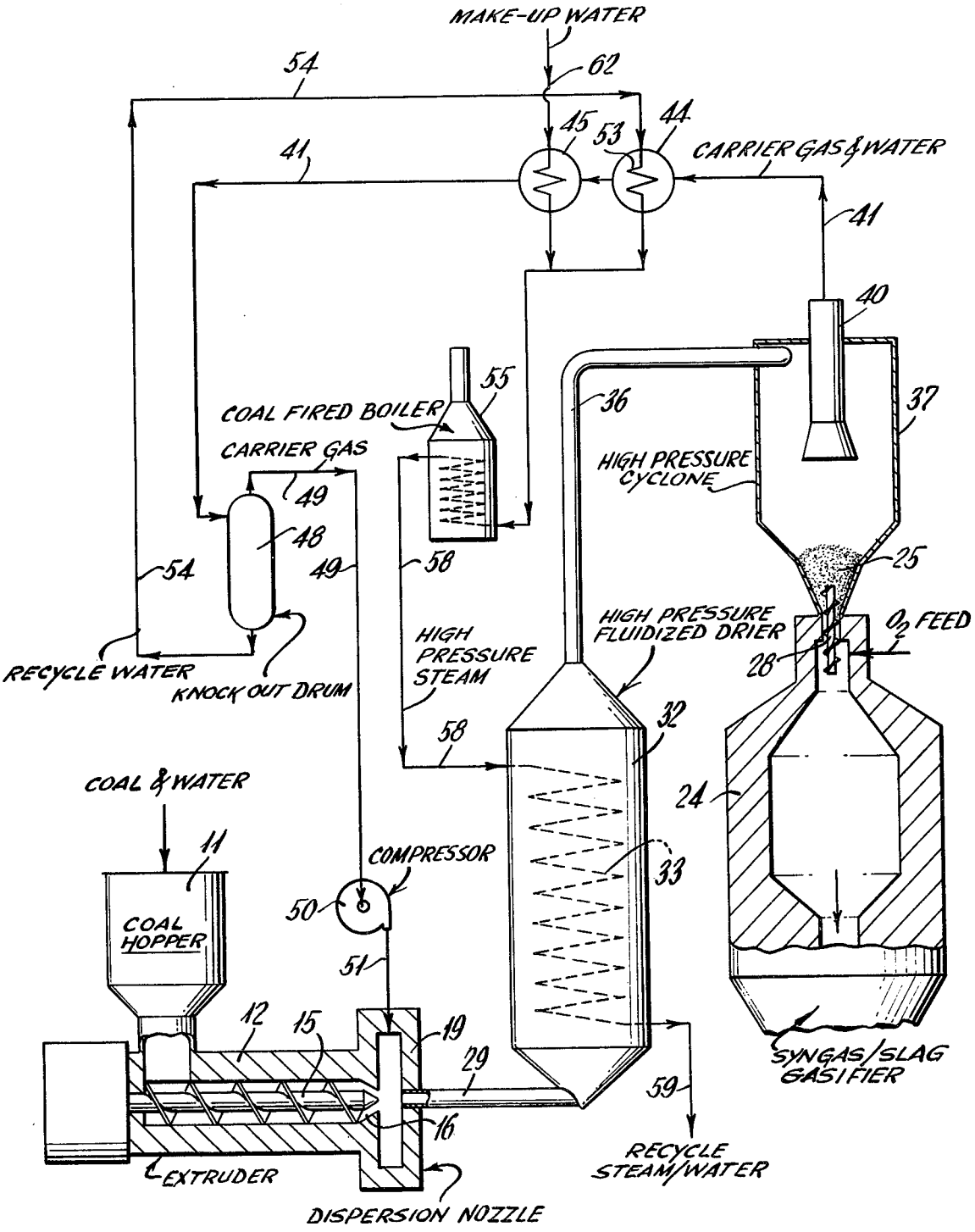
MAKE-UP WATER
62
54
45
53
44
CARRIER GAS & WATER
41
41
40
55
COAL FIRED BOILER
36
37
CARRIER GAS
HIGH PRESSURE CYCLONE
49
48
49
58
25
54
HIGH PRESSURE FLUIDIZED DRIER
$O_2$ FEED
HIGH PRESSURE STEAM
28
RECYCLE WATER
KNOCK OUT DRUM
32
58
COAL & WATER
24
11
COMPRESSOR
33
COAL HOPPER
50
51
12
15
19
29
59
SYNGAS/SLAG GASIFIER
16
RECYCLE STEAM/WATER
EXTRUDER
DISPERSION NOZZLE

COAL GASIFICATION-METHOD OF FEEDING DRY COAL

BACKGROUND OF THE INVENTION

1. Field of the Invention

This invention concerns coal gasification in general and, more specifically, deals with a method of feeding dry powdered coal to a fluidized bed/entrained flow type of coal gasification reactor.

2. Description of the Prior Art

Much effort has been expended in attempting to find a practical feeding system for continuous dry coal feeding in a high pressure coal conversion process. However, attempts at designing such a high pressure feeding system have been plagued with mechanical failures due to high abrasion by the coal or high stresses required by the equipment and low efficiencies of recompressing lost gas.

Consequently, it is an object of this invention to provide a method for supplying a continuous flow of dry, powdered coal with a minimum of problems which have been encountered heretofore.

SUMMARY OF THE INVENTION

Briefly, the invention is related to a coal gasification process employing high pressure conversion of said coal. It concerns a method of feeding dry coal to a high pressure gasifier vessel, and it comprises the steps of feeding powdered coal having a predetermined percentage of water therewith to an extruder. And the steps of extruding said mixture into a high pressure stream of gas while dispersing said extrudate into said gas stream for transport thereby. It also comprises drying said stream of extrudate and gas, and separating said dry extrudate from said gas. Finally, it comprises feeding said separated extrudate into said gasifier vessel.

Again briefly, the invention relates to a coal gasification process employing high pressure conversion of said coal. It concerns a method of feeding dry coal to a high pressured gasifier vessel, and it comprises the steps of feeding powdered coal having a predetermined percentage of water therewith, to an extruder. And the step of extruding said mixture into a high pressure stream of by-product gas from said coal gasification process. It also comprises drying said stream of extrudate and gas with an upward flow in a high pressure fluidized dryer employing superheated steam as the heat source, and separating said dry extrudate from said by-product gas in a high pressure cyclone separator. It also comprises feeding said separated dry extrudate downward into said high pressure gasifier vessel near the top thereof with a screw-type feeder. It also comprises recirculating said high pressure stream of by-product gas after separation of said dry extrudate, and cooling said recirculating stream of by-product gas after said separation. It also comprises removing water from said cooled by-product gas stream, and recycling said removed water to feed a boiler for making said superheated steam. It also comprises using said removed water in said recycling thereof for at least part of said cooling of by-product gas, and reheating said recycled water in said boiler to make said superheated steam for said drying step. The said recirculation of high pressure by-product gas is carried out by compressing said cooled by-product gas stream after said water is removed therefrom.

BRIEF DESCRIPTION OF THE DRAWING

The foregoing and other objects and benefits of the invention will be more fully set forth below in connection with the best mode contemplated by the inventors of carrying out the invention, and in connection with which there are illustrations provided in the drawing, wherein:

The FIGURE of drawing is a schematic flow diagram illustrating a method according to the invention.

DESCRIPTION OF THE PREFERRED EMBODIMENT

Heretofore, no practical dry coal feeder system has been available for high pressure coal conversion processes. The prior processes have relied upon inefficient lock hoppers, or slurry systems, and the slurry would include excess water which is a thermal burden on the process. Even though most gasification systems have required water, this process water has been a burden on the system if the gasifier itself is used to convert the water to steam. However, a method according to this invention will supply a continuous flow of dry, powdered coal with elimination of problems that have been encountered heretofore.

With reference to the drawing figure, it will be observed that the method involves first a supply of coal that is ground to a predetermined fineness and has sufficient moisture therewith (or enough water added) to make the mixture extrudable. Such coal and water mixture is introduced into a coal hopper 11 from which it is fed into an extruder 12 that has a helical screw feed 15 which is schematically indicated.

There is a nozzle section 16 at the exit end of the screw feed helix 15. This is where the extrudate, i.e. mixture of powdered coal and moisture or limited amount of water, is compressed and extruded out the end of the nozzle 16.

It should be noted that the extruder 12 and its parts, i.e. the screw feed 15 and the nozzle 16, are all schematically indicated. It will be understood that any feasible structure or design of the extruder 12 may be employed. It has been found that the extruding action is such that the compacted extrudate in the nozzle provides adequate pressure seal against back pressure from the high pressure system involved, as will appear hereafter.

It has been found that by proper construction, a jet of gas may be directed against the extrudate as it is forced out past the open end of the nozzle section 16. This will act so as to disperse the extrudate into its original finely divided form so that it becomes intermixed with the gas stream. Such dispersion takes place in a section 19 of the extruder 12 that has the caption "dispersion nozzle" applied thereto.

The details of the mechanical arrangement and structure for accomplishing the foregoing dispersion are not part, per se, of this invention. Consequently they are only schematically indicated. Such structural elements will be illustrated and described in one or more copending applications which are to be assigned to the same assignee as this invention.

As indicated above, the invention applies to a coal gasification process that employs high pressure conversion of the coal. Thus, there is a high pressure reactor vessel 24, from the bottom of which the generated synthesis gas and slag from the process, are both discharged. This is indicated by the caption "Syngas/slag gasifier".

It will be understood that there is a feed line for the reactor in order to introduce oxygen near the top of the generator vessel 24. This is indicated by the caption "$O_2$ feed". The process involves high pressure conditions in the reactor, and consequently it is an advantage of the coal feeding method of this invention that it operates at substantially the same high pressure. Consequently, dry powdered coal 25 may be readily fed down into the top of the generator vessel 24, by a simple screw feed element 28.

The dry coal feeding system may be traced from the dispersion section 19 of the extruder 12. It includes a conduit 29 that connects with the dispersion nozzle section 19 and connects into the lower end of a high pressure fluidized dryer 32. Inside the dryer 32 there is a heat exchange coil 33 that carries superheated steam therein. This acts to heat and dry the stream of extrudate, i.e. dispersed powdered coal and water, along with a carrier gas that is at system pressure and acts as a combined stream which flows upward through the dryer 32.

The stream of dry powdered coal and carrier gas mixture flows out the top of dryer 32 and through a conduit 36 into a high pressure cyclone separator 37, near the top thereof. The powdered coal 25 separates and gathers at the bottom of the separator 37, as indicated above and as shown by the reference number 25. At the same time, the carrier gas with the water which has been driven off in the drying process, will exit from the separator 37 through a vertical passageway 40 and be carried over a path indicated by arrows 41 which have the caption "Carrier gas & water" applied thereto.

The separated stream of gases continues over the path 41 via a pair of heat exchangers 44 and 45 for cooling. Then the condensed water is removed from this cooled stream of gases in a knockout drum 48, from which the carrier gas goes over a path indicated by arrows 49, to a compressor 50. From the compressor 50 the carrier gas is introduced to the dispersion nozzle section 19 of the extruder 12 as indicated by an arrow 51.

The water from the knockout drum 48 is recycled over a path indicated by arrows 54 so as to flow through a heat exchange coil 53 in the heat exchanger 44, as indicated. Then the now heated water goes to a coal fired boiler 55 where it is reheated to make high pressure steam, which is indicated by the caption. It will be appreciated that any feasible fuel may be employed to fire the boiler 55. Coal is indicated because it would be cheap and available.

Superheated steam from the boiler 55 then flows over a path indicated by the arrows 58 to the coil 33 of the dryer 32. After passing through the coil 33, the steam and condensed water will be recycled, as is indicated by a caption below an arrow 59 which reads "Recycle steam/water".

It will be noted that in addition to the recycling of water, as indicated above, there will be some provision for introducing make-up water. Thus, there is an arrow 62 with a caption "Make-up Water". This make-up water is directed through the heat exchanger 45 and then joins the recirculating water exiting from the other heat exchanger 44.

It should be noted again that the pressure of the carrier gas, which is being circulated through the above described path and which is employed for carrying the dispersed powdered coal to the cyclone separator, is maintained at a high pressure that is substantially the same as the interior pressure within the synthesis gas generator vessel 24. This permits the simple procedure for introducing the dry powdered coal 25 which is indicated. Thus, the conventional screw feed element 28 introduces the dry powdered coal 25 into the inlet of the generator 24 for reacting with the oxygen feed.

There is no particular specification for the carrier gas that is being used in the system. Consequently, any suitable by-product stream of gas from the gasification plant may be utilized. Thus, for example, nitrogen, as taken from the oxygen plant, may be the carrier gas. Similarly, carbon dioxide from the gasifier may be employed. Or, even steam could be used. Therefore, the dryer 32 may be found useful as a pre-treatment chemical beneficiation step.

Because the carrier gas for circulating the powdered coal is in a closed system at high pressure, the compressor 50 need not be of large size but only needs to supply a pressure differential sufficient for carrying out the dispersion at the extruder nozzle 16.

Among the advantages of a feeding system according to this invention are those related to the ability to feed a high concentration of coal/water mixture into the high pressure system so that in many cases the natural coal and water content is close to the concentration required for extrusion. Therefore, little, if any, additional water would be necessary. Also, the specific heat content of steam changes little with pressure, e.g. it is 1,156 b.t.u. per lb. at 20 p.s.i., 1,204 b.t.u. per lb. at 350 p.s.i., and 1,185 b.t.u. per lb. at 1200 p.s.i., all at the saturation point. Therefore, the energy required to dry the coal under pressure is about the same amount of energy input that would be used if the coal were dried and then injected. However, since the system is under pressure, the density of the gases in the dryer is greater and the heat transfer should be facilitated. This density increase is also beneficial for the operation of the pneumatic transport system.

The method of feeding dry coal to a high pressure gasifier vessel is applicable to a coal gasification process, and it comprises the following steps.

Feeding of powdered coal that has a predetermined percentage of water therewith, is provided for at the input of an extruder. This is illustrated by the coal hopper 11 that is connected to the extruder 12.

Extruding the mixture of coal and water into a high pressure stream of by-product gas, is carried out within the dispersion nozzle section 19. This step has been indicated above, and it includes dispersing the extrudate into the gas stream for being carried along therewith.

Another step is that of drying the stream of extrudate and carrier gas with an upward flow in a high pressure fluidized dryer. This is illustrated by the dryer 32 with the conduit 29 leading into the bottom thereof and the conduit 36 connected to the exit at the top. The heat for drying is supplied via the coil 33 inside of the dryer 32. The coil 33 carries superheated steam, as indicated above.

A next step is that of separating the dry extrudate from the by-product gas in a high pressure cyclone separator. This has been explained above, and it will be observed that the separating step causes the powdered coal 25 to gather at the bottom of the separator 37. The carrier gas including the moisture that has been dried from the coal, goes out the top through the passageway 40 and over the path 41.

Another step is that of feeding the separated dry powdered coal 25 downward into the high pressure gasifier vessel 24. This is carried out near the top of the vessel 24. And, as illustrated and described, it may be readily accomplished with a screw-type feeder 28.

Another step is that of recirculating the high pressure stream of by-product, or carrier gas after separation of the powdered coal therefrom. This is carried out, of course, by the flow of such gas stream through the indicated path 41.

Another step is that of cooling the recirculating stream of by-product gas after the separation. This is accomplished at the heat exchangers 44 and 45 where the recirculating water and the make-up water, respectively, are passed through these exchangers.

Another step is that of removing water from the cooled by-product gas stream. This is done, as described above, by the use of the knockout drum 48 where the water is separated from the carrier gas. The water is taken out the bottom of the drum 48. Such removed water is then recycled to feed the boiler for making the superheated steam. The illustrated system shows the coal-fired boiler 55 which, of course, might take various forms and need not necessarily be fired by coal as the fuel.

It will be observed that in the recycling of the water (as just described above) it is being used for at least part of the cooling of the by-product gas. This was, of course, indicated in connection with the description of the heat exchangers 44 and 45.

Another step is, of course, the reheating of the recycled water. It is carried out in the indicated boiler 55, where the superheated steam is manufactured. Then it goes through the coil 33 in the heater 32.

Finally, it will be noted that the recirculation of the high pressure by-product gas is being carried out by compressing the cooled by-product gas stream, after the water has been removed therefrom. Such compression is carried out by the compressor 50, as described above.

While a particular embodiment of a method according to this invention has been described above in considerable detail, in accordance with the applicable statutes, this is not to be taken as in any way limiting the invention but merely as being descriptive thereof.

We claim:

1. In a coal gasification process employing high pressure conversion of said coal, a method of feeding dry coal to a high pressure gasifier vessel, comprising the steps of feeding powdered coal having a predetermined percentage of water therewith to an extruder, continuously extruding said mixture as a compacted extrudate into a high pressure stream of gas while dispersing said compacted extrudate into powdered coal mixed with said gas stream for transport thereby, drying said stream of dispersed extrudate and gas, separating said dry dispersed extrudate from said gas, and feeding said separated dispersed extrudate into said gasifier vessel.

2. In a coal gasification process according to claim 1, wherein said step of drying is carried out in a high pressure fluidized dryer, and said step of separating is carried out in a high pressure cyclone separator.

3. In a coal gasification process according to claim 2, wherein said step of feeding said separated dispersed extrudate is carried out with a screw type feeder.

4. In a coal gasification process according to claim 3, wherein said high pressure stream of gas comprises a by-product gas from said process.

5. In a coal gasification process according to claim 4, wherein said step of drying employs superheated steam as the source of heat for drying.

6. In a coal gasification process according to claim 5, wherein said step of drying is carried out with an upward flow in said fluidized dryer.

7. In a coal gasification process according to claim 6, wherein said step of feeding separated dispersed extrudate is carried out downward near the top of said gasifier vessel.

8. In a coal gasification process according to claim 7, wherein said method of feeding dry coal also comprises recirculating said stream of high pressure gas after separation of said dry dispersed extrudate.

9. In a coal gasification process according to claim 8, wherein said method of feeding dry coal also comprises cooling said recirculated stream of high pressure gas, and removing water from said cooled gas stream.

10. In a coal gasification process according to claim 9, wherein said method of feeding dry coal also comprises recycling said removed water to use in making said superheated steam for drying.

11. In a coal gasification process according to claim 10, wherein said method of feeding dry coal also comprises using said removed water in said recycling thereof for at least part of said cooling of said recirculated stream of high pressure gas.

12. In a coal gasification process according to claim 11, wherein said method of feeding dry coal also comprises reheating said recycled water to make said superheated steam for said drying step.

13. In a coal gasification process according to claim 9, wherein said recirculating of said high pressure gas stream comprises compressing said cooled gas stream after said water is removed therefrom.

14. In a coal gasification process employing high pressure conversion of said coal, a method of feeding dry coal to a high pressure gasifier vessel, comprising the steps of feeding powdered coal having a predetermined percentage of water therewith to an extruder, continuously extruding said mixture as a compacted extrudate into powdered coal mixed with a high pressure stream of by-product gas from said coal gasification process while dispersing said compacted extrudate into said by-product gas stream for transport thereby, drying said stream of dispersed extrudate and gas with an upward flow in a high pressure fluidized dryer employing superheated steam as the heat source, separating said dry dispersed extrudate from said by-product gas in a high pressure cyclone separator, feeding said separated dry dispersed extrudate downward into said high pressure gasifier vessel near the top thereof with a screw type feeder, recirculating said high pressure stream of by-product gas after separation of said dry dispersed extrudate, cooling said recirculating stream of by-product gas after said separation, removing water from said cooled by-product gas stream, recycling said removed water to feed a boiler for making said supheated steam, recycling said removed water to feed a boiler for making said supheated steam, using said removed water in said recycling thereof for at least part of said cooling of by-product gas, and reheating said recycled water in said boiler to make said supheated steam for said drying step said reciculation of high pressure by-product gas being carried out by compressing said cooled by-product gas stream after said water is removed therefrom.

* * * * *